United States Patent [19]

Rose et al.

[11] 4,336,002

[45] Jun. 22, 1982

[54] TWO STAGE PUMP HAVING AN ELECTROMOTOR DEVICE

[75] Inventors: Klaus Rose, Mundelsheim; Ulrich Kemmner, Sachsenheim; Karl Ruhl, Gerlingen, all of Fed. Rep. of Germany

[73] Assignee: Robert Bosch GmbH, Stuttgart, Fed. Rep. of Germany

[21] Appl. No.: 797,170

[22] Filed: May 16, 1977

[30] Foreign Application Priority Data

May 19, 1976 [DE] Fed. Rep. of Germany ..... 2622155

[51] Int. Cl.[3] ..... F04B 23/14

[52] U.S. Cl. ..... 417/203; 417/205; 417/366; 417/251

[58] Field of Search ..... 417/203, 205, 199 A, 417/201, 366, 423 R, 901, 435, 251; 415/53 T

[56] References Cited

U.S. PATENT DOCUMENTS

| | | | |
|---|---|---|---|
| Re. 29,445 | 10/1977 | Nusser et al. | 417/423 R |
| 2,055,587 | 9/1936 | Pigott | 417/203 |
| 2,153,360 | 4/1939 | Auger et al. | 417/201 |
| 3,836,291 | 9/1974 | Bottcher et al. | 415/53 T |

FOREIGN PATENT DOCUMENTS

| | | | |
|---|---|---|---|
| 990462 | 4/1965 | United Kingdom | 417/251 |

*Primary Examiner*—Richard E. Gluck
*Attorney, Agent, or Firm*—Edwin E. Greigg

[57] ABSTRACT

There is described a pump assembly which, in a unitary structure, comprises an electric pump drive motor and a two stage pump contained within a common housing. The motor drives the first stage of the pump upstream of the second stage which supplies the fuel, by creating a higher output from the first stage, which supply pressure is produced on the suction side of the second stage to maintain the pressure build-up in the pump. An air discharge is provided ahead of the inlet to the suction side of the second stage to dispell gases created in the fuel by the elevated pump pressures.

4 Claims, 3 Drawing Figures

TWO STAGE PUMP HAVING AN ELECTROMOTOR DEVICE

BACKGROUND OF THE INVENTION

The invention comprises a fuel pump for supplying fuel to injection systems of internal combustion engines or, alternatively, to carburetors therefor. The pump is preferably driven by an electromotor and comprises two pump units disposed in series as a two-stage pump. A fuel supply at a low pressure but with a high output is produced on the suction side of a second pump unit by a first pump unit which is disposed upstream of the second unit and which delivers its high output as a gas-free fluid to the second pump unit, which actually feeds the fuel supply to the engine.

The present invention comprises an improvement upon known fuel pumps of the single stage type. The readily evaporable fuels currently in use, such as gasoline, frequently contain 20% by weight of constituents, such as isopenthane, which boil at temperatures of 40° C. Such constituent boiling causes gas bubbles to be formed in fuel pumps of known type, with the result that from 40° C. upwards the proper pressure build-up in the pump may no longer be ensured. Measures known in the prior art for alleviating these conditions, such as producing an excess pressure in the fuel tank or incorporating the fuel pump in the fuel tank, are relatively costly, susceptible to breakdowns, or incompatible with specific safety regulations.

OBJECT AND SUMMARY OF THE INVENTION

The improved fuel pump according to the invention has for an object the provision of fuel without gas formation therein without the above-recited measures being used. It has the advantage that even fuels which contain components which boil at 40° C. can be supplied without the formation of gas bubbles impairing the pressure build-up. A preferred embodiment of the invention will be described in further detail hereinafter with reference to the accompanying drawings, in which:

DESCRIPTION OF THE PREFERRED EMBODIMENT

Figure 1:
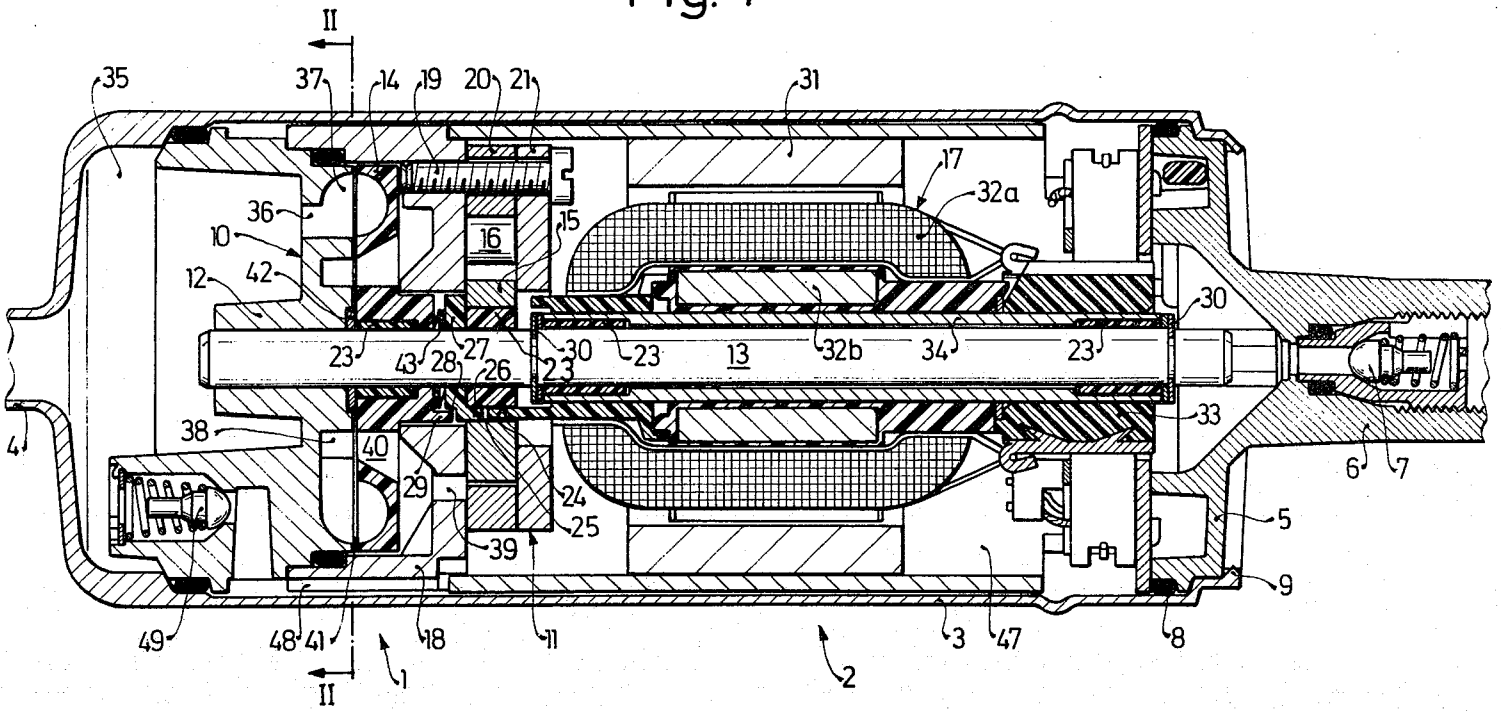
FIG. 1 is a longitudinal sectional view through a fuel supply unit.

The fuel delivery pump shown in the drawings comprises a pump unit 1 containing two pumps which is driven by an electromotor 2. The pumps and motor are housed in a cupshaped housing 3 which includes on its one end a vacuum connection 4 for a fuel hose and which is closed on its other end by a cover 5 on which a pressure connection socket 6 and a check valve 7, acting as an outlet valve, are disposed. A packing 8 is disposed between the housing 3 and the cover 5, and the cover 5, as shown, is secured to the housing 3 via a flange 9 on the open end of the housing 3.

Viewed from the suction side to the pressure side, the housing 3 contains firstly, the pump section 1 and then secondly, the electromotor 2, about which the fuel supplied under pressure by the pumps flows for cooling purposes.

The pump unit 1 comprises two fuel pumps disposed in series. The pump 10 disposed upstream is a hydrodynamic pump and the pump 11 connected in series therewith is a hydrostatic pump. The hydrodynamic pump 10 is represented in the embodiment as a lateral channel pump and the hydrostatic pump 11 as a roller piston pump. The lateral channel pump 10 has a higher delivery output per rotation than the roller piston pump 11 but a substantially lower final pressure. As a result of the pumps being connected in series, a supply pressure which precludes vapor bubbles prevails on the suction side of the roller piston pump 11.

A pump shaft 13 is positively disposed in the central bore of the fixed lateral channel plate 12 of the lateral channel pump 10. The pump shaft 13 is journalled at its other extremity, in the cover 5. The impeller 14 of the lateral channel pump, the pump rotor 15, the rollers 16 of the roller piston pump, and the armature 17 of the electromotor 2 are all mounted on the shaft 13. The base plate 18 of the roller piston pump 11 encompasses in a cup-shaped manner the impeller 14 and is supported adjacent to the lateral channel plate 12. An intermediate plate 20 and support plate 21 are secured by means of bolts 19 to the base plate 18. The base plate 18, intermediate plate 20 and support plate 21 define the pump work chamber of the roller piston pump.

The journal bearings 23 of the impeller 14, pump rotor 15 and armature 17 are mounted in a manner independent of one another and, as a result, marked wear of a particular bearing does not cause one rotating member to adversely influence the other bearing. For similar reasons, rotation-locking entrainment is provided by axial projections engaging between adjacent members in the following manner. A tang 24 which engages in a recess 25 of the pump rotor 15 is formed as an integral part of a bushing that is associated with the armature 17. A pin 26 carried by a ring 27 also engages in this recess 25. The ring 27 is disposed on the shaft 13 and includes a recess 28 in which an axial pin 29 of the impeller 14 engages.

The armature 17 is prevented from axial displacement on the shaft 13 by means of circlips 30. A magnetic element 31 encloses the armature 17. The armature comprises a laminated core **32*b* in addition to windings 32*a*. The latter are connected to a commutator sleeve 33. The laminated core, windings, and commutator sleeve are mounted on a bearing tube 34 which, in turn, receives the journal bearings 23. These members are connected together partially by means of plastic filler parts and partially in a press-fitted manner. The tang 24** which provides the rotation-locking entrainment is also secured in this manner.

The fuel is supplied to the lateral channel 37 by the lateral channel pump 10 from the suction chamber 35 of the supply unit via a suction bore 36. The fuel then passes through a pressure channel 38 (FIG. 2) to the suction inlet 39 of the roller piston pump. In the course thereof the fuel flows through axial recesses 40 which are disposed in the impeller 14.

The pressure which prevails at the suction inlet 39 is determined largely by the width of the gap 41 between the lateral channel plate 12 and the impeller 14. This gap 41 is determined by a spacer 42 and a spring washer 43, which ensures that the impeller 14 abuts the spacer 42.

Figure 2:
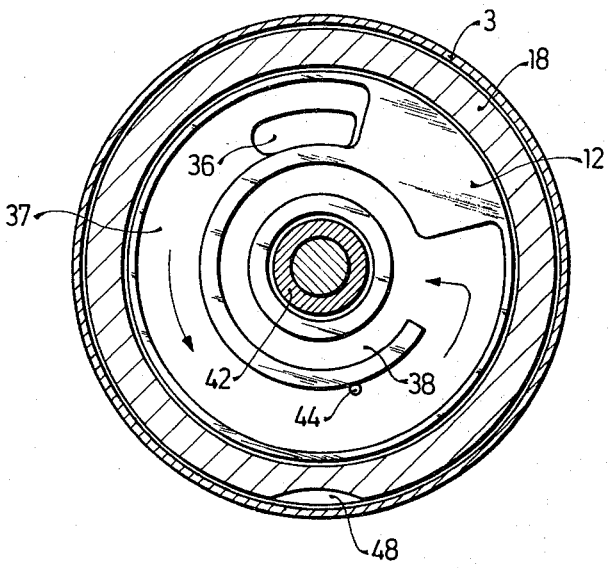
FIG. 2 is a cross-section through the unit along the line II—II in FIG. 1.
Figure 3:
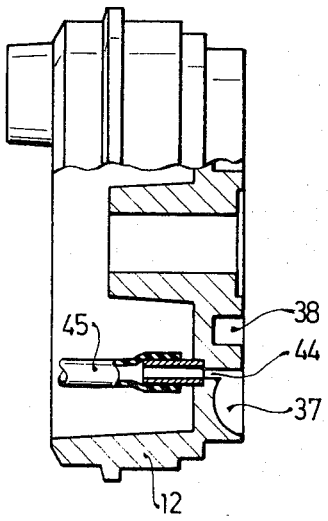
FIG. 3 is a partial longitudinal sectional view showing an air discharge duct.

As is best shown in FIG. 2, an air discharge opening 44 leads to the suction side 35 of the supply unit or, as shown in FIG. 3, is connected via a separate hose 45 to the fuel tank. Any gases forming in the lateral channel pump 10 are discharged in this manner.

The result of this construction is that the pressure channel 38 contains a largely gas-free fluid, from which no gases are released as a result of the elevated pressure, so that there is no impairment of pump pressure.

The roller piston pump 11 delivers its output directly into the chamber 47 that surrounds the electromotor 2. This chamber 47 is connected to the suction side 35 of the supply unit by a channel 48, formed by a recess in the base plate 18 between the base plate and the housing 3, and a pressure control valve 49. This pressure control valve 49 determines the pressure of the fuel supplied to the carburetor or fuel injection system.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel supply unit comprising:

an elongated housing having a fuel inlet at one end and a fuel outlet at the other end, a shaft mounted in said housing, a two stage pump coupled for rotation on said shaft and located adjacent one end of said housing for pumping fuel entering said fuel inlet through said housing and discharging same out said fuel outlet, an electric motor in said housing having an armature mounted on said shaft for driving said two stage pump and being exposed to fuel flowing from said fuel inlet to the fuel outlet, said two stage pump comprising a first pump unit with an impeller and a second pump unit with an impeller, the impellers of both said pump units being mounted on said shaft for rotation by said armature and the inlet of said first pump unit being connected to said fuel inlet and the outlet of said first pump unit being connected to the inlet of said second pump unit with the outlet of said second pump unit being directed to said fuel outlet, said first pump unit being of the type which has a higher fuel flow and a higher delivery output per rotation than said second pump unit, an air discharge duct connecting said outlet of said first pump unit with said fuel inlet for dispelling gases in the fuel being supplied to said second pump unit, further including a recess means in the impeller of said second pump unit, bushing means connected to said armature having an axial projection received in said recess, ring means disposed on said shaft between the impeller of said second pump unit and the impeller of said first pump unit, pin means carried by said ring and also received in said recess, a recess in said ring means, and an axial projection located on the impeller of said first pump unit and received in said recess in said ring means, so that said armature, impellers and ring are in rotational locking engagement with one another.

2. The fuel supply unit as claimed in claim 1 wherein said impellers and armature are journaled on said shaft by separate bearings so that wear on one bearing does not cause one rotating member to adversely influence another bearing.

3. A fuel supply unit comprising a pump having an inlet for connection to a fuel supply and an outlet through which fuel entering said inlet is pumped for use by a fuel utilization device and an electromotor having an armature mounted on a common shaft, said pump comprising first and second axially aligned pump units including rotors that are coupled together and which have different operating pressures, said fuel supply unit including a housing with said shaft extending longitudinally therethrough and on which said pump rotors and said armature are also disposed, said pump rotors and said armature being coupled together for entrainment purposes by means of axial projections which engage in recesses complementary to each projection and located in members on said shaft between said pump rotors; the first of said pump units is disposed upstream of fuel flow whose output is connected to the suction side of said second pump unit for the continuation of said fuel flow through said pump and which has a higher delivery output per rotation with a lower final pressure than said second pump unit, and means in said first of said pump units for dispelling gases at said output before entering the suction side of said second pump unit.

4. A fuel supply unit as claimed in claim 3, in which said impeller, pump rotor and armature are mounted independently of one another on said shaft by being journaled on separate bearings so that wear on one bearing does not cause one rotating member to adversely influence another bearing.

* * * * *